US008414758B2

(12) United States Patent
Deguchi et al.

(10) Patent No.: US 8,414,758 B2
(45) Date of Patent: Apr. 9, 2013

(54) METHOD FOR REDUCING CARBON DIOXIDE

(75) Inventors: Masahiro Deguchi, Osaka (JP); Satoshi Yotsuhashi, Osaka (JP); Yuka Yamada, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/453,669

(22) Filed: Apr. 23, 2012

(65) Prior Publication Data

US 2012/0228146 A1 Sep. 13, 2012

Related U.S. Application Data

(63) Continuation of application No. PCT/JP2011/005345, filed on Sep. 22, 2011.

(30) Foreign Application Priority Data

Mar. 9, 2011 (JP) ..... 2011-051185

(51) Int. Cl.
*C25B 3/04* (2006.01)
*H01M 6/30* (2006.01)
*H01M 8/22* (2006.01)

(52) U.S. Cl.
USPC ..... 205/340; 429/111; 429/505

(58) Field of Classification Search ..... 205/340; 429/111, 505
See application file for complete search history.

(56) References Cited

U.S. PATENT DOCUMENTS 3,649,485 A * 3/1972 Chisholm ..... 204/290.12
4,219,392 A * 8/1980 Halmann ..... 205/340
4,240,882 A * 12/1980 Ang et al. ..... 205/340
4,381,978 A * 5/1983 Gratzel et al. ..... 205/340
4,414,080 A * 11/1983 Williams et al. ..... 205/340
4,460,443 A * 7/1984 Somorjai et al. ..... 205/340
4,478,699 A * 10/1984 Halmann et al. ..... 429/111

(Continued)

FOREIGN PATENT DOCUMENTS

JP 50-115178 A 9/1975
JP 55-105625 8/1980

(Continued)

OTHER PUBLICATIONS

International Search Report issued in International Patent Application No. PCT/JP2011/005345, filed Sep. 22, 2011.

(Continued)

*Primary Examiner* — Keith Hendricks
*Assistant Examiner* — Colleen M Raphael
(74) *Attorney, Agent, or Firm* — McDermott Will & Emery LLP

(57) ABSTRACT

A device for reducing carbon dioxide includes a cathode chamber including a cathode electrolyte solution and a cathode electrode, an anode chamber including an anode electrolyte solution and an anode electrode, and a solid electrolyte membrane. The anode electrode includes a nitride semiconductor region on which a metal layer is formed. The metal layer includes at least one of nickel and titanium. A method for reducing carbon dioxide by using a device for reducing carbon dioxide includes steps of providing carbon dioxide into the cathode solution, and irradiating at least part of the nitride semiconductor region and the metal layer with a light having a wavelength of 250 nanometers to 400 nanometers, thereby reducing the carbon dioxide contained in the cathode electrolyte solution.

19 Claims, 6 Drawing Sheets

U.S. PATENT DOCUMENTS

| | | | | |
|---|---|---|---|---|
| 4,523,981 | A * | 6/1985 | Ang et al. | 205/340 |
| 4,533,608 | A * | 8/1985 | Somorjai et al. | 429/111 |
| 4,545,872 | A * | 10/1985 | Sammells et al. | 205/340 |
| 4,668,349 | A * | 5/1987 | Cuellar et al. | 205/555 |
| 4,975,161 | A * | 12/1990 | Nidola et al. | 205/532 |
| 5,022,970 | A * | 6/1991 | Cook et al. | 205/340 |
| 8,138,380 | B2 * | 3/2012 | Olah et al. | 205/555 |
| 2008/0245672 | A1 * | 10/2008 | Little et al. | 205/555 |
| 2008/0286643 | A1 * | 11/2008 | Iwasaki | 429/111 |
| 2009/0020410 | A1 | 1/2009 | Niwa et al. | |
| 2009/0045072 | A1 * | 2/2009 | Fujii et al. | 205/340 |
| 2010/0187123 | A1 * | 7/2010 | Bocarsly et al. | 205/340 |
| 2010/0258446 | A1 * | 10/2010 | Mohapatra et al. | 205/340 |
| 2011/0174610 | A1 * | 7/2011 | Nomura et al. | 204/252 |

FOREIGN PATENT DOCUMENTS

| | | | |
|---|---|---|---|
| JP | 63-247388 | | 10/1988 |
| JP | 01-313313 | | 12/1989 |
| JP | 05-059562 | | 3/1993 |
| JP | 06-158374 | | 6/1994 |
| JP | 3876305 | B2 | 1/2007 |
| JP | 2007-107043 | | 4/2007 |
| JP | 2007-260667 | | 10/2007 |
| JP | 4158850 | B2 | 10/2008 |
| JP | 4167775 | B2 | 10/2008 |
| JP | 2009-255013 | | 11/2009 |

OTHER PUBLICATIONS

Yoshio Hori, "Production of CO and $CH_4$ in Electrochemical Reduction of $CO_2$ at Metal Electrodes in Aqueous Hydorgencarbonate Solution," Chemistry Letters, pp. 1695-1698, 1985.

D. Behar et al., "Cobalt Porphyrin Catalyzed Reduction of $CO_2$, Radiation Chemical, Photochemical, and Electrochemical Studies," Journal of Physical Chemistry A, vol. 102, pp. 2870-2877, 1998.

Manfred Rudolph et al., "Macrocyclic [$N_4^2$-] Coordinated Nickel Complexes as Catalysts for the Formation of Oxalate by Electrochemical Reduction of Carbon Dioxide," Journal of American Chemical Society, vol. 122, pp. 10821-10830, 2000.

Tooru Inoue et al., "Photoelectrocatalytic reduction of carbon dioxide in aqueous suspensions of semiconductor powders," Nature, vol. 277, pp. 637-638, 1979.

Hiroyuki Takeda et al., "Development of efficient photocatalytic systems for CO2 reduction using mononuclear and multinuclear metal complexes based on mechanics studies," Coordination Chemistry Reviews, vol. 254, pp. 346-354, 2010.

Somnath C. Roy et al., "Toward Solar Fuels: Photocatalytic Conversion of Carbon Dioxide to Hydrocarbons," ACS Nano, vol. 4, No. 3, pp. 1259-1278, 2010.

* cited by examiner

METHOD FOR REDUCING CARBON DIOXIDE

This application is a Continuation of PCT/JP2011/005345 filed on Sep. 22, 2011, which claims foreign priority of Japanese Patent Application No. 2011-051185 filed on Mar. 9, 2011, the entire contents of both of which are incorporated herein by reference.

The present disclosure relates to a method for reducing carbon dioxide.

The present disclosure is directed to a method for reducing carbon dioxide with use of a device for reducing carbon dioxide. The method includes a step (a) of preparing the device for reducing carbon dioxide. The device for reducing carbon dioxide includes a cathode chamber, an anode chamber and a solid electrolyte membrane. The cathode chamber includes a cathode electrode that has a metal or a metal compound. The anode chamber includes an anode electrode that has a nitride semiconductor region on the surface thereof. A part of the surface of the region is covered with a nickel or titanium region that is in contact with the nitride semiconductor region.

The device further includes a first electrolyte solution held in the cathode chamber and a second electrolyte solution held in the anode chamber. The cathode electrode is in contact with the first electrolyte solution and the anode electrode is in contact with the second electrolyte solution. The solid electrolyte membrane is interposed between the cathode chamber and the anode chamber. The first electrolyte solution contains the carbon dioxide. The cathode electrode is electrically connected to the anode electrode. The anode electrode has an anode electrode terminal for collecting electrons generated in the anode electrode. The nickel or titanium region is apart from the anode electrode terminal.

The method further includes a step (b) of irradiating at least part of the nitride semiconductor region on which the nickel or titanium region are formed with a light having a wavelength of 250 nanometers to 400 nanometers to reduce the carbon dioxide contained in the first electrolyte solution. The nickel or titanium region is irradiated with the light.

A method for reducing carbon dioxide by using a device for reducing carbon dioxide, wherein the device for reducing carbon dioxide includes:

a cathode chamber including a cathode electrolyte solution and a cathode electrode;

an anode chamber including an anode electrolyte solution and an anode electrode, the anode electrode including a nitride semiconductor region on which a metal layer are formed; and a solid electrolyte membrane, the method comprising steps of:

providing carbon dioxide into the cathode solution; and irradiating at least part of the nitride semiconductor region and the metal layer with a light having a wavelength of 250 nanometers to 400 nanometers, thereby reducing the carbon dioxide contained in the cathode electrolyte solution, wherein the metal layer includes at least one of nickel and titanium.

ADVANTAGEOUS EFFECT

The present disclosure provides a novel method for reducing carbon dioxide.

DESCRIPTION OF EMBODIMENTS

The embodiment of the present subject matter is described below.

Embodiment 1

Device for Reducing Carbon Dioxide

Figure 1:
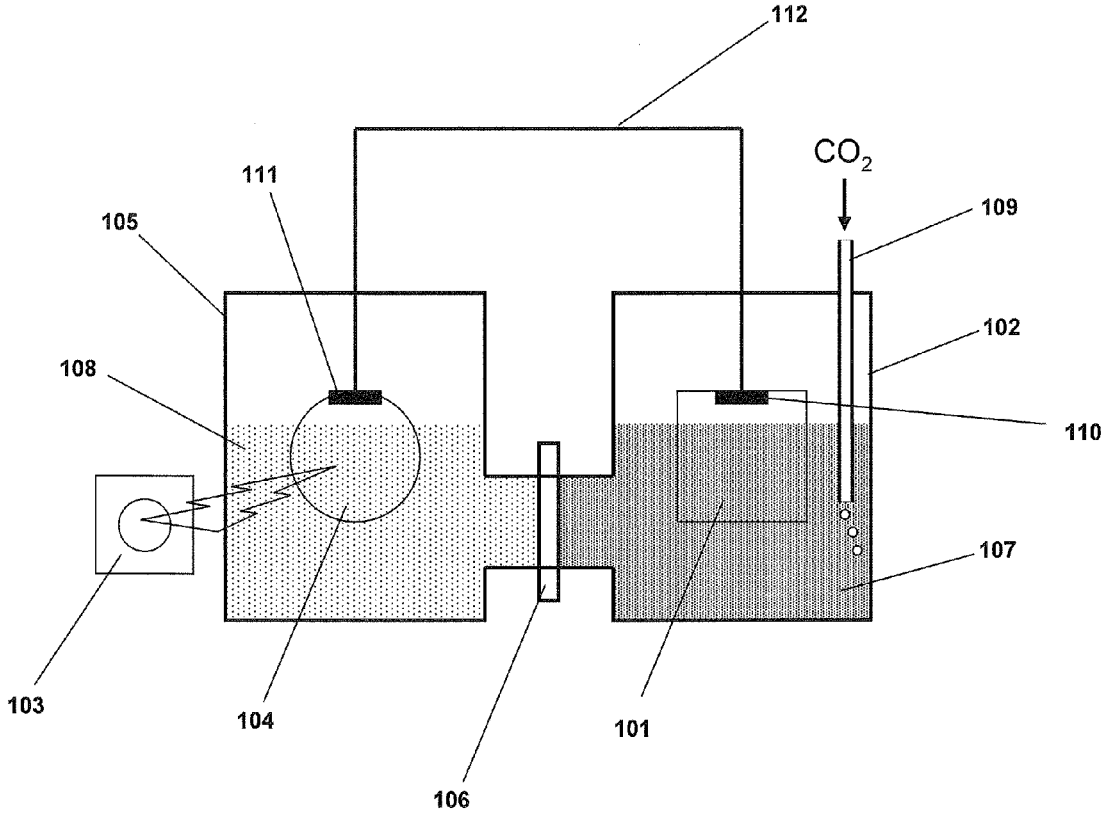
FIG. 1 shows an exemplary device for reducing carbon dioxide according to embodiment 1.

FIG. 1 shows an exemplary device for reducing carbon dioxide according to embodiment 1. The device includes a cathode chamber 102, an anode chamber 105, and a solid electrolyte membrane 106.

The cathode chamber 102 includes a cathode electrode 101.

The cathode electrode 101 is in contact with a first electrolyte solution 107. Particularly, the cathode electrode 101 is immersed in the first electrolyte solution 107.

An example of the material of the cathode electrode 101 is copper, gold, silver, cadmium, indium, tin, lead or alloy thereof. Copper is preferred. Another example of the material of the cathode electrode 101 is a metal compound capable of reducing carbon dioxide. As it is necessary that the material be in contact with the first electrolyte solution 107, only a part of the cathode electrode 101 may be immersed in the first electrolyte solution 107 as long as the material is in contact with the first electrolyte solution 107.

The anode chamber 105 includes an anode electrode 104.

The anode electrode 104 is in contact with a second electrolyte solution 108. Particularly, the anode electrode 104 is immersed in the second electrolyte solution 108.

Figure 2A:
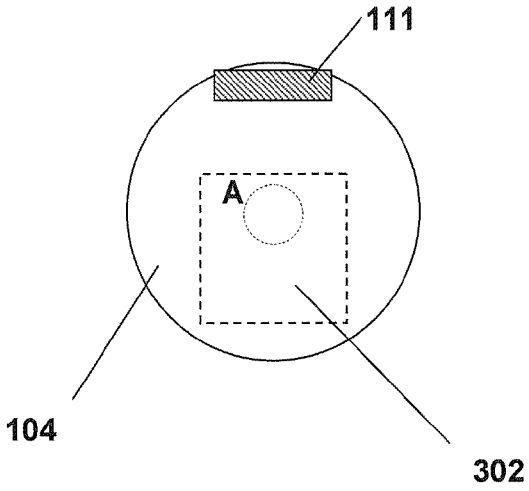
FIG. 2A shows an exemplary anode electrode 104.

As shown in FIG. 2A, the anode electrode 104 includes a nitride semiconductor region 302 on its surface. The nitride semiconductor region 302 is formed of nitride semiconductor. The nitride semiconductor is preferably gallium nitride. In FIG. 2A, a square nitride semiconductor region 302 is formed on a part of the surface of the anode electrode 104. However, the nitride semiconductor region 302 may be formed on the whole surface of the anode electrode 104. The shape of the nitride semiconductor region 302 is not limited to a square. The anode electrode 104 is composed of a sapphire substrate/a GaN region 302/a nickel or titanium region 303. A GaN substrate may be used instead of a laminate of a sapphire substrate/a GaN layer 302.

Figure 2B:
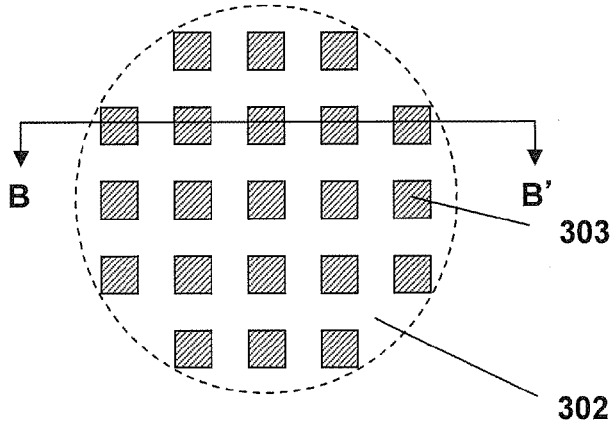
FIG. 2B shows a partially enlarged view of the circle A in FIG. 2A.
Figure 2C:
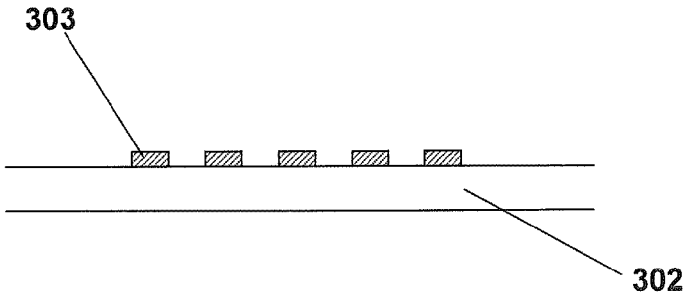
FIG. 2C shows a cross-sectional view of the B-B line in FIG. 2B.

As shown in FIG. 2B, a part of the surface of the nitride semiconductor region 302 is covered with a nickel or titanium region 303. It is preferable that a plurality of nickel or titanium regions 303 are provided. To more exact, the plurality of nickel or titanium region 303 are preferably dispersed on the surface of the nitride semiconductor region 302. As one example, the plurality of nickel or titanium regions 303 are arranged in a matrix state. In FIG. 2B, the plurality of nickel or titanium regions 303 are formed within circle "A" which constitutes a portion of the nitride semiconductor region 302. However, the plurality of nickel or titanium regions 303 may be formed in the whole nitride semiconductor region 302.

It is preferable that the total area of the nickel or titanium region 303 is less than three-tenth (3/10) times smaller than the area of the nitride semiconductor region 302. If the total area of the nickel or titanium region 303 is equal to or larger than three-tenth times of the area of the nitride semiconductor region 302, too much light may be shielded by the nickel or titanium region 303 and the amount of the light which reaches the nitride semiconductor region 302 is too small.

The nickel or titanium region 303 is in contact with the nitride semiconductor. In case where the nickel or titanium region 303 fails to be in contact with the nitride semiconductor, the effect of the present subject matter is not achieved. The nickel or titanium region 303 contains nickel or titanium. Preferably, the nickel or titanium region 303 is made of nickel, titanium, nickel alloy, or titanium alloy.

One example of the shape of the nickel or titanium region 303 is a dot or a particle. In FIG. 2B, the shape of the nickel or titanium region 303 is square; however, it is not limited to square.

Only a part of the anode electrode 104 may be immersed in the second electrolyte solution 108 as long as the nitride semiconductor region 302 and the nickel or titanium region 303 are in contact with the second electrolyte solution 108.

The first electrolyte solution 107 is held in the cathode chamber 102. The second electrolyte solution 108 is held in the anode chamber 105.

An example of the first electrolyte solution 107 is a potassium bicarbonate aqueous solution, a sodium bicarbonate aqueous solution, a potassium chloride aqueous solution, a potassium sulfate aqueous solution, or a potassium phosphate aqueous solution. A potassium bicarbonate aqueous solution is preferred. Preferably, the first electric solution 107 is mildly acidic under the condition that carbon dioxide is dissolved in the first electric solution 107.

An example of the second electrolyte solution 108 is a sodium hydroxide aqueous solution or a potassium hydroxide aqueous solution. A sodium hydroxide aqueous solution is preferred. Preferably, the second electrolyte solution 108 is strong basic.

The solute of the first electrolyte solution 107 may be identical to that of the second electrolyte solution 108; however, it is preferable that the solute of the first electrolyte solution 107 is different from that of the second electrolyte solution 108.

The first electrolyte solution 107 contains carbon dioxide. The concentration of the carbon dioxide is not limited.

In order to separate the first electrolyte solution 107 from the second electrolyte solution 108, the solid electrolyte membrane 106 is interposed between the cathode chamber 102 and the anode chamber 105. Namely, the first electrolyte solution 107 and the second electrolyte solution 108 are not mixed in the present device.

The material of the solid electrolyte membrane 106 is not limited, as long as only a proton penetrates the solid electrolyte membrane 106 and the other material cannot penetrate the solid electrolyte membrane 106. One example of the solid electrolyte membrane 106 is Nafion (Registered Trade Mark).

The cathode electrode 101 includes a cathode electrode terminal 110. The anode electrode 104 includes an anode electrode terminal 111. The cathode electrode terminal 110 and the anode electrode terminal 111 are electrically connected through a conductive wire 112. In one example, the cathode electrode 101 is physically and electrically connected to the anode electrode 104 by the conductive wire 112.

Here, an external power supply such as a battery or a potentiostat is not electrically interposed between the cathode electrode 101 and the anode electrode 104.

The anode electrode terminal 111 is provided for collecting electrons generated in the anode electrode 104 and for supplying the electrons to the conductive wire 112. The electrons are generated by the irradiation of UV light. The anode electrode terminal 111 is preferably provided on the nitride semiconductor region 302. The nickel or titanium region 303 is apart from the anode electrode terminal 111. In other words, a space is interposed between the nickel or titanium region 303 and the anode electrode terminal 111.

As understood from this description, the nickel or titanium region 303 is not physically contacted to the anode electrode terminal 111 directly. In other words, the nickel or titanium region 303 is electrically connected to the anode electrode terminal 111 indirectly through the nitride semiconductor region 302.

Method for Reducing Carbon Dioxide

Next, the method for reducing carbon oxide with use of the above-mentioned device is described below.

The device is put at a room temperature and under atmospheric pressure.

As shown in FIG. 1, the nitride semiconductor region 302 on which the nickel or titanium region 303 is formed is irradiated with the light from the light source 103. To more exact, at least part of the nitride semiconductor region 302 on which the nickel or titanium region 303 is formed is irradiated with the light. Thus, the nickel or titanium region 303 is also irradiated with the light. The whole nitride semiconductor region 302 may be irradiated with the light. The light which is not shielded by the nickel or titanium region 303 reaches the nitride semiconductor region 302. An example of the light source 103 is a xenon lamp.

It is preferred that the light from the light source 103 have a wavelength of not less than 250 nanometers and not more than 400 nanometers. Preferably, the light has a wavelength of not less than 250 nanometers and not more than 365 nanometers.

As shown in FIG. 1, the device preferably includes a tube 109. It is preferred that the carbon dioxide contained in the first electrolyte solution 107 is reduced while carbon dioxide is supplied through the tube 109 to the first electrolyte solution 107. One end of the tube 109 is immersed in the first electrolyte solution 107. It is preferred that a sufficient amount of carbon dioxide is dissolved in the first electrolyte solution 107 by supplying carbon dioxide through the tube 109 before the reduction of carbon dioxide starts.

The carbon dioxide contained in the first electrolyte solution 107 is reduced to form carbon monoxide or formic acid, when the cathode electrode 101 includes metal such as copper, gold, silver cadmium, indium, tin, or lead.

EXAMPLE 1

The present subject matter is described in more detail with reference to the following example.

Preparation of the Anode Electrode

An n-type gallium nitride film 302 was epitaxially grown on a sapphire substrate by a metal organic chemical vapor deposition method. Next, a plurality of the nickel regions 303 shown in FIG. 2B were formed in a matrix state with a known semiconductor process such as a photolithography, an electron beam deposition, and a lift off method. Each nickel region 303 had a shape of a dot. The nickel regions 303 were approximately 5 micrometers square and 0.5 micrometers thick. The interval between two adjacent nickel regions 303 was approximately 50 micrometers. Thus, as shown in FIG. 2B, obtained was the anode electrode 104 including the nitride semiconductor region 302 formed of the n-type gallium nitride having the plurality of nickel regions 303.

Assemblage of the Device

The device for reducing carbon dioxide shown in FIG. 1 was formed with use of the anode electrode 104. The device is described below in more detail.

Cathode electrode 101: A copper plate

First electrolyte solution 107: Potassium bicarbonate aqueous solution with a concentration of 0.1 mol/L (180 ml)

Second electrolyte solution 108: Sodium hydroxide aqueous solution with a concentration of 1.0 mol/L (180 ml)

Solid electrolyte membrane 106: Nafion membrane (available from DuPont Kabushiki Kaisha, trade name: Nafion 117)

Light source 103: Xenon Lamp (Output: 300 W)

The light source 103 emitted a broad light with a wavelength of 250 nanometers to 400 nanometers.

Reduction of Carbon Dioxide

Carbon dioxide was supplied for thirty minutes through the tube 109 to the first electrolyte solution 107 by bubbling.

The anode chamber 105 had a window (not shown). The nitride semiconductor region 302 was irradiated with the light from the light source 103 through the window.

Figure 3:
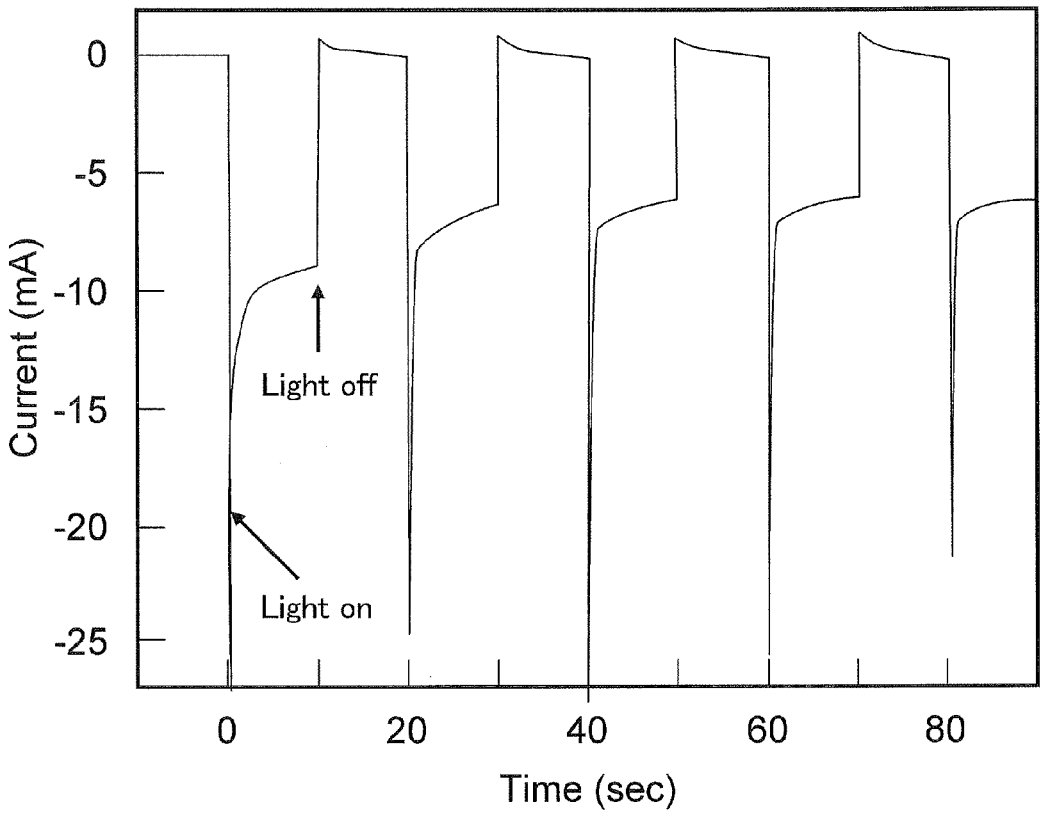
FIG. 3 is a graph showing a current change before and after the nitride semiconductor region 302 was irradiated with the light in example 1.

FIG. 3 is a graph showing a current change before and after the nitride semiconductor region 302 was irradiated with the light. As shown in FIG. 3, when the region 320 was irradiated with the light, a current flew through the wire 112. When the region was not irradiated with the light, the flow of the current stopped. This means a reaction occurred in at least one electrode of the cathode electrode 101 and the anode electrode 104 by the light irradiation. It is one of photo-voltaic reactions.

The present inventors investigated the reaction in more detail as below. Particularly, after the anode chamber 102 was sealed, the nitride semiconductor region 302 was irradiated with the light once again. A gas component generated in the anode chamber 102 was analyzed with a gas chromatography. A liquid component generated in the anode chamber 102 was analyzed with a liquid chromatography.

As a result, it was confirmed that formic acid, carbon monoxide, and methane generated in the anode chamber 102.

Figure 4:
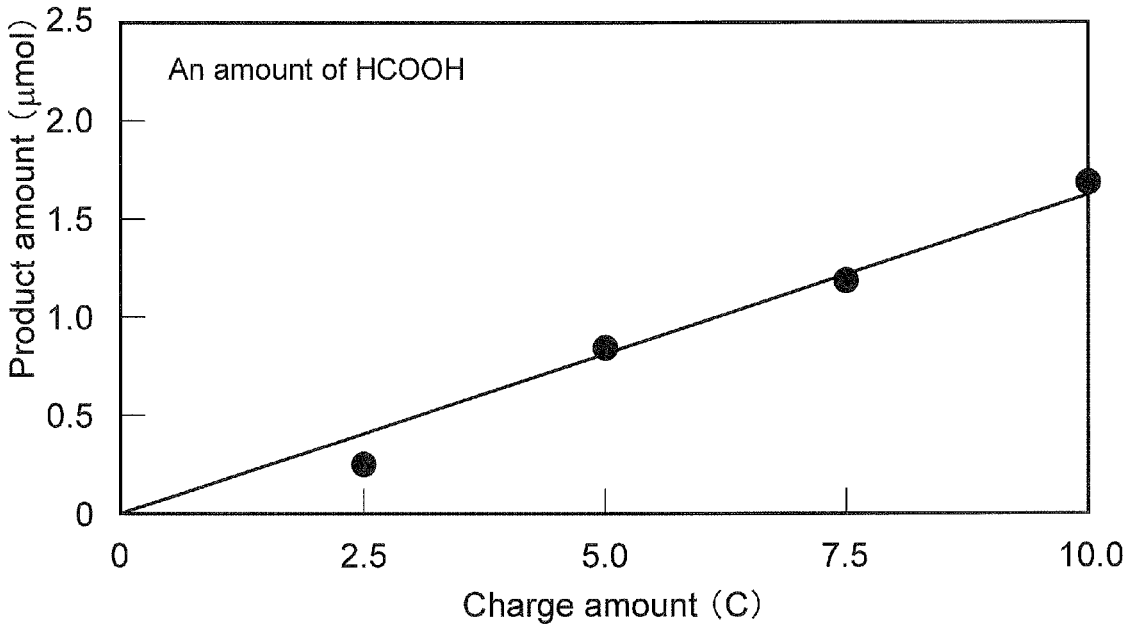
FIG. 4 shows a relation ship between the charge amount (horizontal axis) and the amount of the formic acid (vertical axis) in example 1.

Furthermore, a charge amount (coulomb amount) was calculated from the light current amount caused by the irradiation of the light. FIG. 4 shows a relation ship between the charge amount (horizontal axis) and the amount of the formic acid (vertical axis). As is clear from FIG. 4, the amount of the formic acid is proportional to the charge amount. This means that a catalytic reaction by which the carbon dioxide was reduced occurred due to the irradiation of the light.

EXAMPLE 2

An identical experiment to example 1 was performed except that a plurality of titanium regions 303 were formed instead of the plurality of nickel region 303.

EXAMPLE 3

An identical experiment to example 1 was performed except that a plurality of nickel region 303 each having a shape of a particle were formed instead of the plurality of nickel region 303 each having a shape of a dot.

COMPARATIVE EXAMPLE 1

An identical experiment to example 1 was performed except that nickel or titanium regions 303 were not formed on the surface of the anode electrode.

Figure 5:
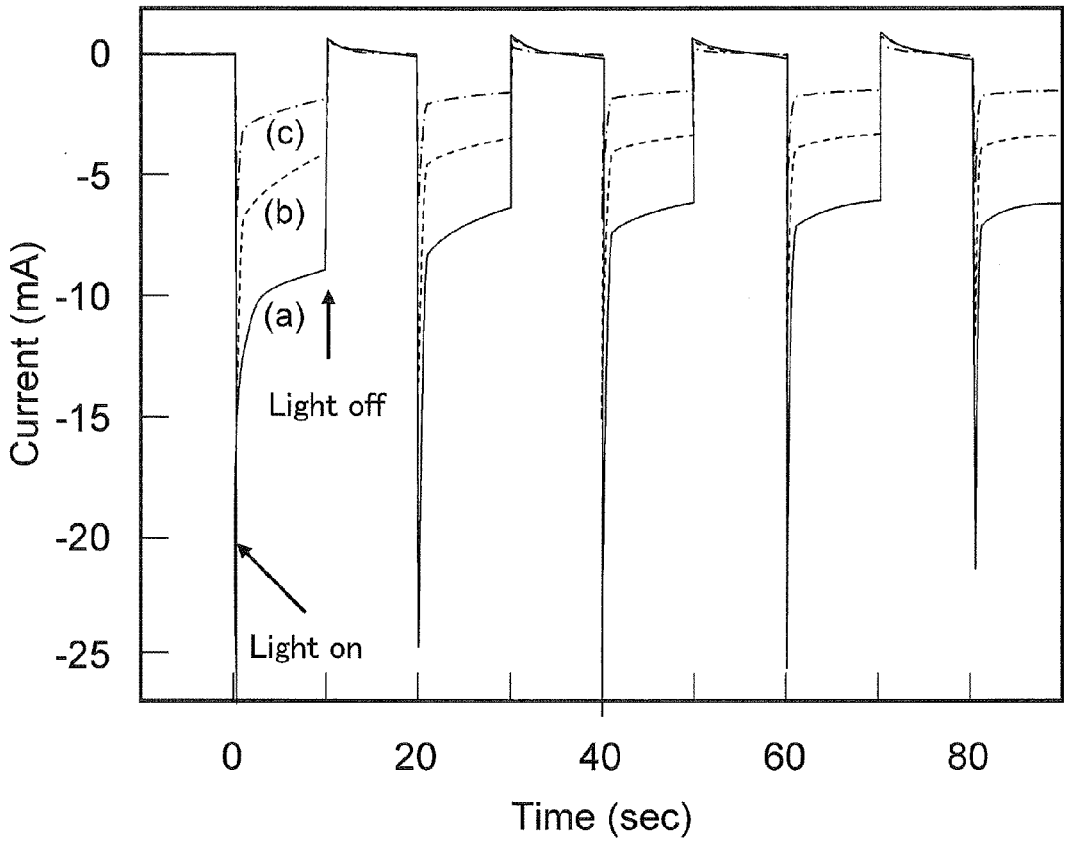
FIG. 5 is a graph showing a current change before and after the nitride semiconductor region 302 was irradiated with the light in example 1, example 2, and comparative example 1.

FIG. 5 is a graph showing a current change before and after the nitride semiconductor region 302 was irradiated with the light in example 1, example 2, and comparative example 1. In FIG. 5, reference signs (a), (b), and (c) indicate the results of example 1, example 2, and comparative example 1, respectively. As shown in FIG. 5, the current amount in example 1 was the largest, and the current amount in comparative example 1 was the smallest, although the part of the nitride semiconductor region 302 was covered with the nickel region 303. This means that the reduction reaction of carbon dioxide is promoted by forming the nickel region 303 on the nitride semiconductor region 302.

Figure 6:
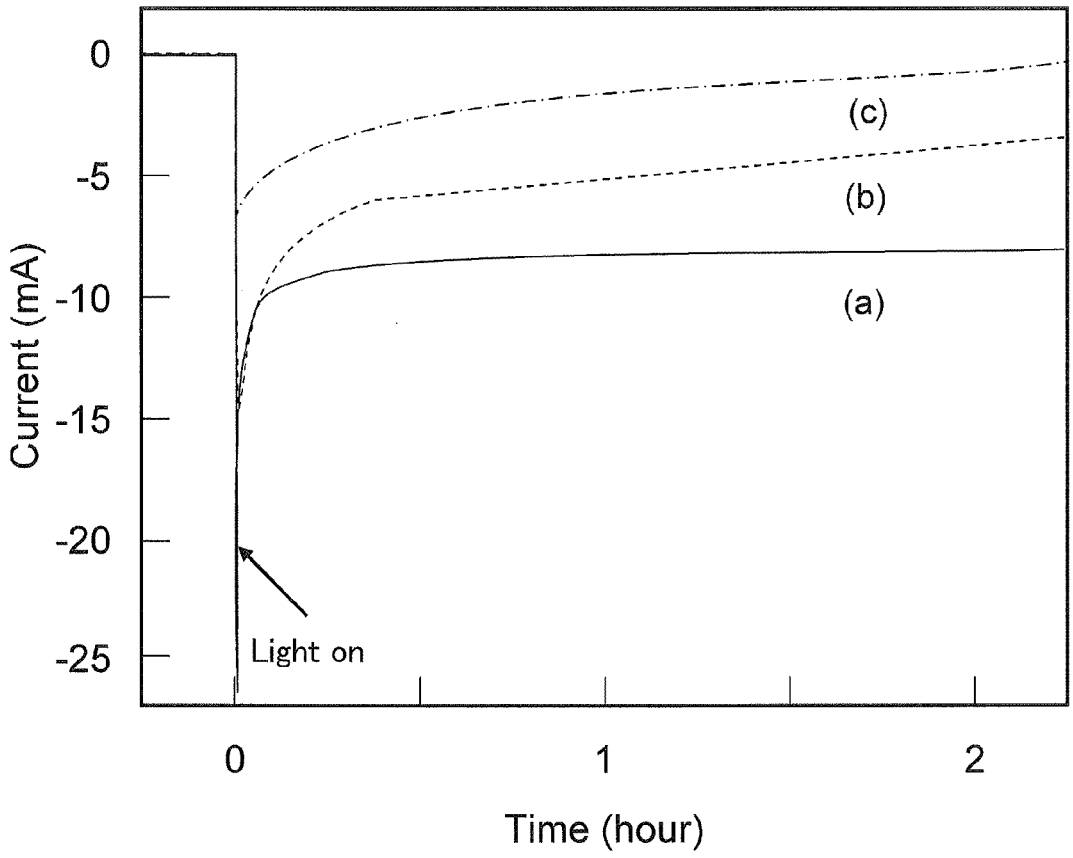
FIG. 6 is a graph showing the relationship between the time when the anode electrode is irradiated with light and the photo-electric current amount.

FIG. 6 shows a graph showing the relationship between the light irradiation time to the anode electrode (horizontal axis) and the light current amount (vertical axis). In FIG. 6, reference signs (a), (b), and (c) indicate the results of example 1, example 2, and comparative example 1, respectively. As shown in FIG. 6, the stability of the current amount with respect to the time change was the highest in example 1. The stability was the second highest in example 2. This means that the deterioration of the anode electrode 104 is suppressed by forming the nickel region 303 on the nitride semiconductor 302 which is irradiated with the light.

As is clear from FIG. 5 and FIG. 6, the production amount per unit time of the formic acid was increased when the nickel or titanium regions 303 were used. The production amount per unit time of the formic acid was more increased when the nickel regions 303 was used. As is clear from FIG. 5 and FIG. 6, nickel is preferred to titanium. In the example 3, in which the nickel particles were used, the production amount of the formic acid was more increased.

COMPARATIVE EXAMPLE 2

An identical experiment to example 1 was performed except that a titanium oxide film was formed instead of the n-type gallium nitride film 302.

As a result, when the titanium oxide film was irradiated with the light, a current flowed between the cathode electrode 101 and the anode electrode 104. However, only hydrogen was generated in the cathode chamber 102. In the cathode chamber 102, carbon monoxide, formic acid, or methane was not generated. This means that the carbon dioxide contained in the first electrolyte solution 107 failed to be reduced.

COMPARATIVE EXAMPLE 3

An identical experiment to example 1 was performed except that platinum regions were formed instead of the nickel regions 303.

As a result, even when the nitride semiconductor region 302 was irradiated with the light, little current flowed between the cathode electrode 101 and the anode electrode 104. Instead, a large amount of hydrogen was generated in the anode chamber 105. This means that the carbon dioxide contained in the first electrolyte solution 107 failed to be reduced.

INDUSTRIAL APPLICABILITY

The present subject matter provides a method for reducing carbon dioxide.

REFERENCE SIGNS LIST

101: cathode electrode
102: cathode chamber
104: anode electrode
105: anode chamber
106: solid electrolyte membrane
107: first electrolyte solution
108: second electrolyte solution
302: nitride semiconductor region
303: nickel or titanium region

What is claimed is:

1. A method for reducing carbon dioxide with use of a device for reducing carbon dioxide, the method comprising steps of:

a step (a) of preparing the device for reducing carbon dioxide, wherein:

the device comprises:

a cathode chamber;

an anode chamber; and a solid electrolyte membrane, the cathode chamber comprises a cathode electrode including a metal or a metal compound, the anode chamber comprises an anode electrode including a nitride semiconductor region on the surface thereof, a part of the surface of the nitride semiconductor region is covered with a nickel or titanium region, the nickel or titanium region is in contact with the nitride semiconductor region, a first electrolyte solution is held in the cathode chamber, a second electrolyte solution is held in the anode chamber, the cathode electrode is in contact with the first electrolyte solution, the anode electrode is in contact with the second electrolyte solution, the solid electrolyte membrane is interposed between the cathode chamber and the anode chamber, the first electrolyte solution contains the carbon dioxide, the cathode electrode is electrically connected to the anode electrode, a battery or a potentiostat as an external power supply is not electrically interposed between the cathode electrode and the anode electrode, the anode electrode comprises an anode electrode terminal for collecting electrons generated in the anode electrode, and the nickel or titanium region is apart from the anode electrode terminal; and a step (b) of irradiating at least part of the nitride semiconductor region on which the nickel or titanium region are formed with a light having a wavelength of 250 nanometers to 400 nanometers so as to cause a current to flow between the cathode electrode and the anode electrode and to reduce the carbon dioxide contained in the first electrolyte solution at the cathode electrode, the nickel or titanium region being irradiated with the light.

2. The method according to claim 1, wherein the nitride semiconductor region includes gallium nitride.

3. The method according to claim 2, wherein the gallium nitride is a n-type.

4. The method according to claim 1, wherein the nitride semiconductor region includes n-type nitride semiconductor.

5. The method according to claim 1, wherein the cathode electrode comprises a metal.

6. The method according to claim 5, wherein the metal is copper, gold, silver, cadmium, indium, tin, lead or alloy thereof.

7. The method according to claim 6, wherein the metal is copper.

8. The method according to claim 1, wherein the first electrolyte solution is a potassium bicarbonate aqueous solution, a sodium bicarbonate aqueous solution, a potassium chloride aqueous solution, a potassium sulfate aqueous solution, or a potassium phosphate aqueous solution.

9. The method according to claim 8, wherein the first electrolyte solution is a potassium bicarbonate aqueous solution.

10. The method according to claim 1, wherein the second electrolyte solution is a sodium hydroxide aqueous solution or a potassium hydroxide aqueous solution.

11. The method according to claim 1, wherein in the step (b), the device is left at a room temperature and under atmospheric pressure.

12. The method according to claim 1, wherein the total area of the nickel or titanium region is less than three-tenth times smaller than the area of the nitride semiconductor region.

13. The method according to claim 1, wherein the nickel or titanium region includes a plurality of nickel or titanium regions, respectively.

14. The method according to claim 13, wherein the plurality of nickel or titanium regions are provided in a matrix state.

15. The method according to claim 1, wherein the nickel or titanium region has a shape of a dot.

16. The method according to claim 1, wherein the nickel or titanium region has a shape of a particle.

17. The method according to claim 1, wherein in the step (b), formic acid is obtained.

18. The method according to claim 1, wherein in the step (b), carbon monoxide is obtained.

19. The method according to claim 1, wherein in the step (b), methane is obtained.

* * * * *